United States Patent [19]

Williams

[11] 3,946,197

[45] Mar. 23, 1976

[54] ELECTRODE WATER HEATING BOILER

[76] Inventor: Stanley Austen Williams, 10 Durlston Road, Parkstone, Poole, BH14 8PQ, Dorset, England

[22] Filed: July 19, 1974

[21] Appl. No.: 490,214

[30] Foreign Application Priority Data

July 24, 1973 United Kingdom ..... 35166/73

[52] U.S. Cl. ..... 219/290; 219/285; 219/289; 219/291; 219/294; 338/82; 338/84

[51] Int. Cl.[2] ..... H05B 3/60; H01C 10/02

[58] Field of Search ..... 219/284–295, 219/271–276; 338/80–86

[56] References Cited

UNITED STATES PATENTS

| | | | |
|---|---|---|---|
| 1,386,487 | 8/1921 | Forssblad | 219/290 |
| 1,403,102 | 1/1922 | Perkins | 219/294 |
| 1,446,317 | 2/1923 | Penzold | 219/290 |
| 1,513,250 | 10/1924 | Kaelin | 219/285 |
| 2,453,776 | 11/1948 | Beath et al. | 219/290 |
| 3,666,917 | 5/1972 | Oglesby | 219/294 X |

FOREIGN PATENTS OR APPLICATIONS

| | | | |
|---|---|---|---|
| 372,659 | 4/1923 | Germany | 219/290 |
| 145,946 | 7/1962 | U.S.S.R. | 219/294 |
| 383,196 | 11/1932 | United Kingdom | 219/290 |
| 2,867 | 2/1932 | Australia | 219/294 |

*Primary Examiner*—A. Bartis
*Attorney, Agent, or Firm*—Michael J. Striker

[57] ABSTRACT

A high-voltage hot water boiler includes a plurality of fluid heating units arranged parallel to each other. Each fluid heating unit includes a cylindrical housing which serves as a counter-electrode. Each housing is provided with a fluid inlet and a fluid outlet so that fluid to be heated can be conducted therethrough and the housing is supported so that the fluid flow path is closer to the horizontal than to the vertical. An electrode extending in the flow direction is provided in each housing for cooperation with the counter-electrode to electrolytically heat the fluid flowing through the flow path. A nozzle, which may be electrically conductive, is associated with the electrode to direct incoming fluid towards the latter. An electrically-insulating sleeve surrounds the electrode and is movable by an adjusting means both in and opposite to the flow of the fluid to modify the flow of current between the electrode and counter-electrode. The adjusting means also simultaneously adjusts the position of the nozzle means relative to the electrode. Manifolds connect the fluid inlets and the fluid outlets of the units together for parallel fluid flow. The adjusting means of the units are ganged together for simultaneous operation.

9 Claims, 5 Drawing Figures

ELECTRODE WATER HEATING BOILER

This invention relates to an improved water heater operating at high tension (by which I mean a voltage in excess of 1 KV) and heating the water by direct passage of current between an electrode at high voltage and a counter electrode at earth potential, both immersed in the water. Throughout this specification the term "boiler" will be used to describe such a water heater although it should be understood that in its normal intended mode of operation it will be water and not steam which leaves the boiler.

According to the present invention a high tension electrode hot water boiler comprises an electrically conducting boiler casing forming a counter electrode, an inlet adjacent one end of the casing for feeding water to be heated to the boiler, an outlet adjacent to the opposite end of the casing for passing heated water from the boiler, means to support an electrode within the casing so that the electrode is electrically insulated from the casing and extends in the direction of flow of water as it passes from end to end of the casing, and means to support the casing so that the flow direction is closer to the horizontal than to the vertical.

Preferably, the casing is of circular cylindrical shape and is mounted so that its axis is horizontal. Axes inclined at angles less than 45° to the horizontal are not ruled out, although the advantages afforded by the invention increase as the angle of inclination approaches zero.

Preferably, the boiler comprises a tubular current modifying means mounted within the casing for movement both in the opposite to the water flow direction to or through a position in which it at least partly surrounds the electrode and modifies the electric current flow between the electrode and the counter electrode as a function of its position, and control means for moving the modifying means to or through said position.

Suitably the modifying means is a sleeve of electrically insulating material mounted on a carrier movable within the casing. Conveniently the end of the carrier adjacent to the inlet supports a flow-controlling nozzle arranged to ensure that inlet water flows directly towards the electrode, particularly when the modifying means is in its position for maximum power output. The nozzle may be of conducting material and be electrically connected to the counter electrode to form a part of the counter electrode.

Normally the boiler will be designed to operate on a three-phase supply and in this case three similar casings each with its own electrode would be provided. Preferably, the three casings are connected in parallel so far as water flow is concerned, there being a common water inlet to the casings and a common water outlet therefrom. When such a three-phase boiler is provided with the above-mentioned modifying means, each casing would be provided with its own modifying means and control means therefor, the three control means being suitably ganged together to ensure that the electrical load does not become unbalanced as power adjustments are made.

One embodiment of high tension electrode hot water boiler will now be described, by way of example, with reference to the accompanying drawings, in which.

Figure 1:
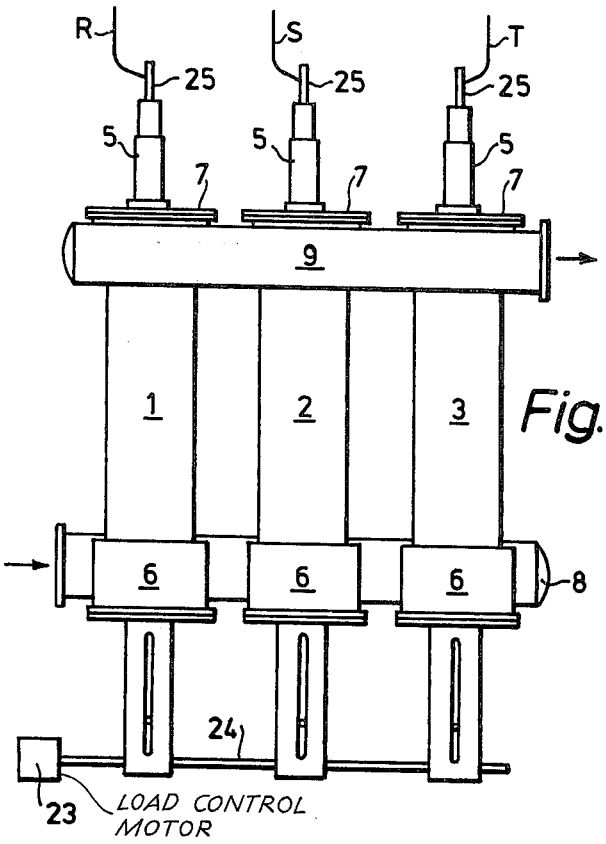
FIGS. 1, 2 and 3 are a plan, end view and side view, respectively, of the boiler.
Figure 2:
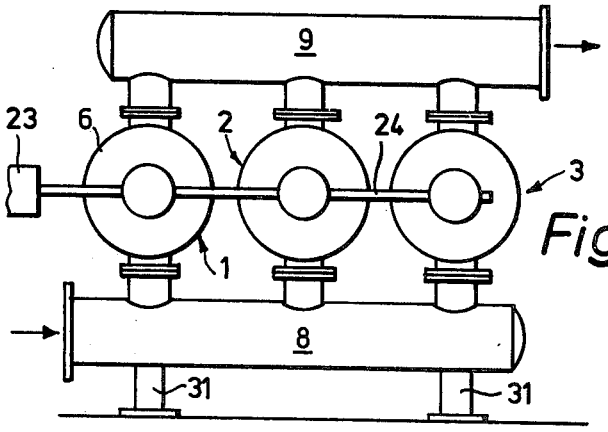
Figure 3:
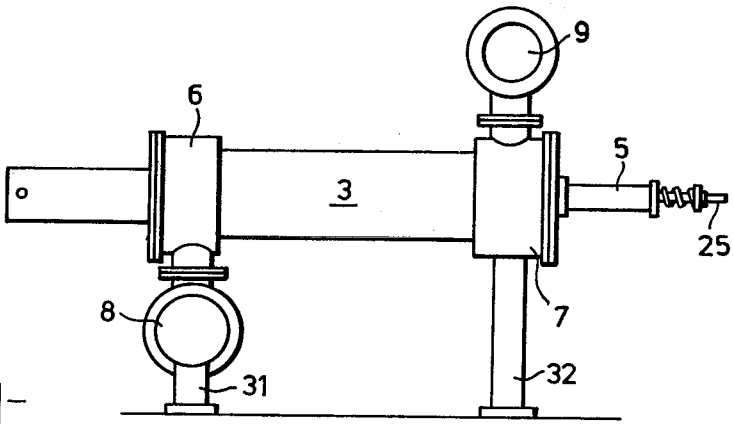
Figure 4:
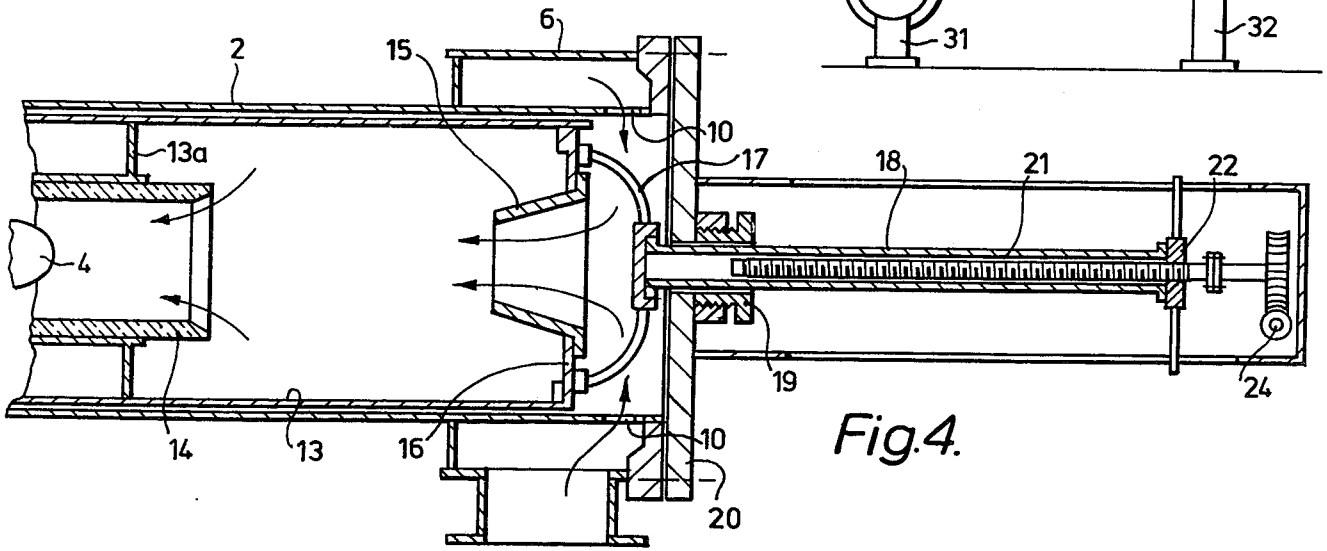
FIG. 4 is a sectional schematic view of part of one of the casings of the boiler of FIGS. 1–3 showing a minimum load position.
Figure 5:
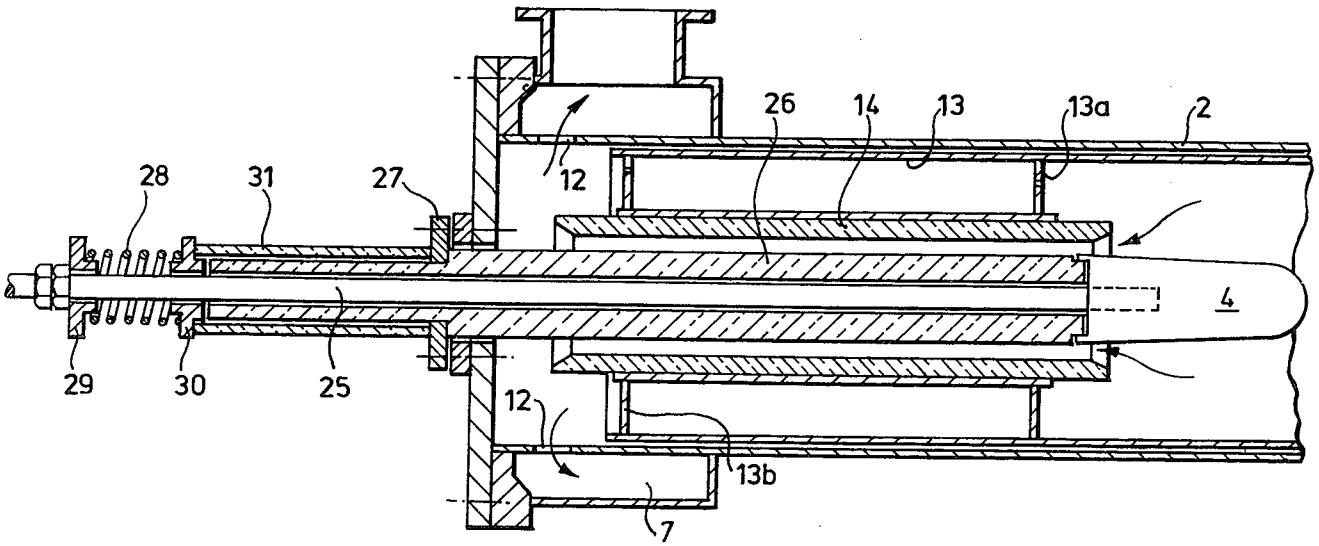
FIG. 5 is a view corresponding to FIG. 4 showing the other end of the casing and indicating a maximum load position.

The boiler shown in FIGS. 1 to 3 comprises three tubular steel casings 1, 2 and 3 mounted on supports 31 and 32 so that the casing axes are substantially horizontal. Supported in each casing is an axially disposed cast iron electrode 4 (see FIGS. 4 and 5). The three electrodes are electrically insulated from the casings and are connected to phase lines R, S and T. A typical operating voltage is in the range 11 to 13 KV, so that ceramic insulators 5 are employed to withstand the high voltage difference between the phase lines and the casings. Each end of each casing is provided with an enlarged annular collar, these defining inlet collars 6 at the ends remote from the insulators 5, and outlet collars 7 at the ends adjacent to the insulators 5. The inlet collars 6 are connected in parallel to an inlet manifold 8 and the outlet collars 7 are connected in parallel to an outlet manifold 9. FIG. 4 shows how communication between an inlet collar 6 and the interior of the casing is achieved via inlet openings 10 and FIG. 5 shows the communication from the casing to the outlet collar 7 via outlet openings 12.

Slidably located in each casing is a tubular member 13 supporting a porcelain pipe 14 and a flow-controlling nozzle 15. The member 13 is terminated at its end facing the inlet end of the casing by an annular plate 16 and an array of arms 17 connecting the member 13 to a stainless steel tube 18. The tube 18 is slidably received in a gland 19 in an end wall 20 of the casing.

A rotatable lead screw 21 is housed within the tube 18, the latter engaging the former by means of a threaded nut 22 non-rotatably secured to the tube 18. A load control motor 23 (see FIG. 1) is provided which acts, via a shaft 24, to turn the three screws 21 in synchronism, when an adjustment has to be made in the power output from the boiler. As the shaft 24 rotates in one direction or the other, the three screws turn and cause the tubes 18 to be pushed into or pulled out of the casings, moving the members 13, pipes 14 and nozzles 15 between the limiting positions shown in FIGS. 4 and 5.

In the position shown in FIG. 4 the pipe 14 surrounds the electrode 4 screening it, to a major extent, from the counter electrode (formed by the casing and conducting parts of the member 13). The position shown in FIG. 4 represents the minimum load position.

In the position shown in FIG. 5, the nut 22 has moved close to the end wall 20 and the pipe 14 no longer surrounds the electrode, thus permitting more current to flow between the electrode and the earthed counter electrode. FIG. 5 represents the maximum load position.

The nozzle 15 may be of electrically insulating material or of cast iron. If of the latter, it acts as a part of the counter electrode and has an effect on power output which increases as it moves closer to the electrode 4.

Since the only way for water to pass into the mid region of the casing is through the nozzle 15, the nozzle ensures that the water flow impinges on the electrode particularly in the maximum load position shown in FIG. 5. The pipe 14 is supported coaxially in the member 13 by two annular plates 13*a* and 13*b*. Small holes are formed in these plates but the only substantial flow path for water from the inlet to the outlet of any casing is through the pipe 14.

The electrode 4 is shown threaded on the end of a steel conducting rod 25 which is connected to the phase lead R, S or T. Within the casing, the rod 25 is surrounded by a ceramic tube 26, held in place by an annular collar 27. The electrode 4 is urged against the adjacent end of the tube 26 by means of a helical spring 28 acting between a flange 29 secured to the rod 25 and a sleeve 30 pressing against an outer ceramic tube 31.

Conventional three-phase high tension electrode hot water boilers have the flow direction sensibly vertical, the three electrodes being housed in a common vertical tubular casing which gives a tall structure (15 feet or more is not uncommon) which is difficult to service the heavy top of the large casing has to be removed for this purpose. By the simple expedient of mounting each electrode in its own tubular casing and disposing these casings side by side with their axes substantially horizontal, I have provided a boiler which is much shorter than prior art boilers of comparably power output and is short enough to be accommodated in a standard height room, and which is easier to service (since only the casing housing the defective component need by opened).

By mounting the casings side-by-side in the horizontal direction I find I can simplify the control means and the modifying means to give more reliable operation and more precise control. Using a water distribution nozzle mounted on the modifying means, to move with the latter, has a significant advantage in that it improves water distribution to the electrode throughout the load range and, where the nozzle is part of the counter electrode, it permits the obtaining of a higher maximum load.

By mechanically coupling the three lead screws 21 together I can obtain very precise control of load output. The individual phases can be balanced initially by making independent adjustments of the nuts 22 and once the boiler is adjusted in this way between phases, control over the entire power range can be effected by operating the motor 23 without appreciable unbalance between the phases occurring.

The boiler illustrated has a maximum height of 7 feet, an overall length of 13 feet and an overall width of 10 feet. It has a rating of 10 Megawatts and is capable of raising the temperature of 70,000 lbs of water per minute through from 5° to 8°F.

The main advantages of the design of boiler described with reference to the drawings are thought to be:

1. Low headroom required. Boiler can be installed in a standard height room.
2. Very positive water circulation around the electrode.
3. Very easy adjustment of the load in each shell to get perfect load balance.
4. Very easy servicing.
5. No vibration of the load control tube.
6. The moving nozzle, if of metal, helps to obtain heavier loads.

What is claimed is:

1. An apparatus for heating fluids, particularly a high-voltage hot water boiler, comprising at least one fluid-heating unit, each of said fluid heating units including a housing formed of electrically conductive material and serving as a counter electrode, said housing having an inlet for conducting fluid to be heated in a path through said housing and an outlet for conducting heated fluid from said housing; means for supporting said housing so that the flow direction of said fluid path is closer to the horizontal than to the vertical; an electrode electrically insulated from said housing and extending in said flow direction and cooperating with said counter electrode so as to electrolytically heat the fluid flowing in said path; modifying means for modifying the electric current flow between said electrode and said counter electrode as a function of position, said modifying means comprising a carrier movable within said housing, a sleeve of electrically insulating material mounted on said carrier so as to move with the latter both in and opposite to the direction of fluid flow to or through a position in which said sleeve at least partly surrounds said electrode, and adjusting means connected to said carrier for moving the same to or through said position in which said sleeve surrounds said electrode; and flow control means including a nozzle located at one end of said carrier adjacent to said inlet for directing incoming fluid substantially towards said electrode.

2. An apparatus as claimed in claim 1, wherein a plurality of said fluid-heating units are provided parallel to each other, each of said units being energized by being connected to one phase of a three-phase electrical energy source; an inlet manifold connecting the housing inlets of said units in parallel; an outlet manifold connecting the housing outlets of said units in parallel; and means for ganging the respective adjusting means associated with each of said fluid-heating units together for simultaneous operation.

3. An apparatus as claimed in claim 2, wherein said plurality of fluid-heating units comprises three units connected in parallel with respect to fluid flow.

4. An apparatus as claimed in claim 1, wherein said nozzle is made of electrically conducting material and is electrically connected to said counter electrode to form a part of said counter electrode.

5. An apparatus for heating fluids, particularly a high-voltage hot water boiler, comprising at least one fluid-heating unit, each of said fluid heating units including a housing formed of electrically conductive material and serving as a counter electrode, said housing having an inlet for conducting fluid to be heated in a path through said housing and an outlet for conducting heated fluid from said housing; means for supporting said housing so that the flow direction of said fluid path is closer to the horizontal than to the vertical; an electrode electrically insulated from said housing and extending in said flow direction and cooperating with said counter electrode so as to electrolytically heat the fluid flowing in said path; flow control means provided in said fluid path for directing the flow of fluid substantially towards said electrode, said flow control means being formed of electrically conductive material and being electrically connected with said housing; and means for varying the spacing between said flow control means and said electrode so as to vary the flow of electrical current between said electrode and said counter electrode and thereby handle different loading requirements.

6. An apparatus as claimed in claim 5, said fluid-heating unit further comprising a tubular current modifying means mounted within said housing for movement both in and opposite to the fluid flow direction to or through a position in which it at least partly surrounds said electrode and modifies the electric current flow between said electrode and said counter electrode as a function of its position, and adjusting means for moving said modifying means to or through said position.

7. An apparatus as claimed in claim 6, wherein three of said fluid-heating units are provided parallel to each other and means for ganging each of the adjusting means associated with the respective fluid-heating units together for simultaneous operation so that the electrical load is free from imbalance as a power adjustment is made.

8. An apparatus as claimed in claim 6, wherein said modifying means is a sleeve of electrically insulating material mounted on a carrier movable within said housing.

9. An apparatus as claimed in claim 5, wherein said housing is of circular cylindrical shape and is mounted so that its axis is substantially horizontal.

* * * * *